US005614999A

United States Patent [19]

Kanesawa et al.

[11] Patent Number: 5,614,999

[45] Date of Patent: Mar. 25, 1997

[54] FIXING APPARATUS FOR REDUCING IMAGE DISTORTION

[75] Inventors: Yoshio Kanesawa; Yasuhiro Uehara; Yasuhiro Kusumoto, all of Ebina, Japan

[73] Assignee: Fuji Xerox Co., Ltd., Tokyo, Japan

[21] Appl. No.: 541,929

[22] Filed: Oct. 10, 1995

[30] Foreign Application Priority Data

Oct. 14, 1994 [JP] Japan ..... 6-249705
Sep. 21, 1995 [JP] Japan ..... 7-267668

[51] Int. Cl.[6] ..... G03G 15/20

[52] U.S. Cl. ..... 399/329; 219/216

[58] Field of Search ..... 355/285, 290; 219/216; 432/59, 60

[56] References Cited

U.S. PATENT DOCUMENTS

| | | | |
|---|---|---|---|
| 5,177,550 | 1/1993 | Uehara et al. | 355/284 |
| 5,345,300 | 9/1994 | Uehara et al. | 355/285 |
| 5,359,401 | 10/1994 | Uehara et al. | 355/285 |
| 5,436,430 | 7/1995 | Baruch et al. | 219/216 |
| 5,530,556 | 6/1996 | Miura et al. | 355/285 X |

FOREIGN PATENT DOCUMENTS

| | | |
|---|---|---|
| 0411852 | 2/1991 | European Pat. Off. . |
| 0503358 | 9/1992 | European Pat. Off. . |
| 52-69337 | 6/1977 | Japan . |
| 59-46668 | 3/1984 | Japan . |
| 60-104852 U | 7/1985 | Japan . |
| 60-151677 | 8/1985 | Japan . |
| 60-151681 | 8/1985 | Japan . |
| 62-14675 | 1/1987 | Japan . |
| 2-30961 | 2/1990 | Japan . |
| 4-50885 | 2/1992 | Japan . |
| 5-150679 | 6/1993 | Japan . |
| 6-250560 | 9/1994 | Japan . |

*Primary Examiner*—Arthur T. Grimley
*Assistant Examiner*—Sophia S. Chen
*Attorney, Agent, or Firm*—Oliff & Berridge

[57] ABSTRACT

A fixing apparatus comprising built-in heating means, a heat-fixing roll which is driven to rotate, and an endless pressure belt which is stretched along a plurality of rolls and made to be contact and wound around the heat-fixing roll, wherein the heat-fixing roll is provided with a resilient layer on the peripheral surface thereof; one of the plurality of rolls for stretching the pressure belt is a pressure roll which is located in a press contact portion where the pressure belt is forced to be contact with the heat-fixing roll on the downstream side in the direction of rotation of the heat-fixing roll and pressed against the heat-fixing roll so that the resilient layer of the heat-fixing roll undergoes compressional deformation; an auxiliary pressure roll is provided on the upstream side of the press contact portion and forced to be contact with the heat-fixing roll via the pressure belt; and a soft resilient layer formed of material not harder than what is used to form the resilient layer of the heat-fixing roll is formed on the peripheral surface of the auxiliary pressure roll.

12 Claims, 6 Drawing Sheets

FIXING APPARATUS FOR REDUCING IMAGE DISTORTION

BACKGROUND OF THE INVENTION

The present invention relates to a fixing apparatus for heat-fixing an unfixed toner image in an imaging apparatus utilizing eletrophotography in copying machines, printers, facsimiles and the like, and more particularly to a belt-nip type fixing apparatus.

There are known fixing apparatus for fixing an unfixed toner image carried on a recording sheet by heating-melting such a toner image. A typical fixing apparatus is designed to fix a toner image by forcing a pressure belt capable of endless movement to be contact a heat-fixing roll rotatably supported, and feeding a recording sheet between them. For example, Japanese Unexamined Patent Publications Nos. 69337/1977, 151677/1985, 151681/1985, 14675/1987, Japanese Unexamined Utility Model Publication Nos. 104852/1985, 30961/1990 (No. Hei 2-30961) and Japanese Unexamined Patent Publications Nos. 50885/1992, 150679/1993 disclose fixing apparatus of the sort mentioned above.

FIG. 7 shows a fixing apparatus proposed by the present patent applicants and disclosed in Japanese Unexamined Patent Publication No. 150679/1993. A heat-fixing roll 101 used in this fixing apparatus has a cylindrical core 112 of metal such as aluminum offering a high thermal conductivity and a resilient layer 120 formed on the surface of the core. The resilient layer 120 is formed with a primary layer 113 of HTV silicone rubber for directly covering the surface of the core, and a topcoat 114 of RTV silicone rubber for covering the primary layer.

A halogen lamp 107 as a heat source is placed inside the core. Further, a temperature sensor 111 in contact with the surface of the heat-fixing roll 101 is installed and used for measuring the temperature of the surface of the resilient layer. A temperature controller (not shown) operates to control ON/OFF of the halogen lamp 107 according to a measurement signal from the temperature sensor 111, so that the temperature of the surface of the heat-fixing roll 101 is adjusted to a predetermined level. Moreover, a parting agent is supplied by an oil supply unit 110 to the surface of the heat-fixing roll 101, whereby part of an unfixed toner image 116 is prevented from being offset-printed on the heat-fixing roll 110 when the unfixed toner image 116 is fixed on a recording sheet 115.

The pressure belt 102 is stretched along support rolls 104, 105 and a pressure roll 103, and the pressure roll 103 is forced to be contact with the heat-fixing roll 101, so that part of the pressure belt 102 is in contact with and wound around the heat-fixing roll 101. Further, an auxiliary pressure roll 106 is pressed against the heat-fixing roll 101 via the pressure belt on the upstream side of a portion where the heat-fixing roll 101 and the pressure belt 102 contact each other. When the heat-fixing roll 101 is driven to rotate, the pressure belt circumferentially rotates in direction of arrow in FIG. 7, and the aforementioned contact portion forms a nip through which the recording sheet 115 carrying the toner image 116 is passed. When the recording sheet 115 carrying the unfixed toner image is fed into the nip, it is held between the heat-fixing roll 101 and the pressure belt 102 before being conveyed further. Toner is then melted by the heat transmitted from the heat-fixing roll 101 and forced by the press contact force of the pressure belt 102 or the pressure roll 103 to stick to the recording sheet 115.

The adoption of the belt-nip type fixing apparatus like this is advantageous in that the recording sheet conveyance speed is increased while fixing time is sufficiently secured in comparison with an apparatus in which a heat-fixing roll and a pressure roll are forced to be contact with each other without using a pressure belt, since the recording sheet is continuously fed to cover the length of the belt nip (the length in the range in which the pressure belt is kept in contact with the heat-fixing roll) and is also continuously heated. As the heating time in the belt-nip type is longer than that in any other type without using the pressure belt provided the conveyance speed is equal, moreover, a great deal of heat can be transmitted by means of toner. Accordingly, the belt-nip type fixing apparatus is specifically fit for use in a color copying machine in which multilayer toner is to be colored as desired.

In the fixing apparatus, further, the resilient layer 120 is formed on the surface of the heat-fixing roll 101. The resilient layer 120 is deformed on receiving the press contact force of the pressure roll so as to be slightly distorted in the circumferential direction. In other words, a portion of the resilient layer 120 that the pressure roll is forced to be contact is distorted as the heat-fixing roll 101 turns and that portion is set free from distortion after the heat-fixing roll 101 turns further. When the heat-fixing roll 101 is driven to rotate at a peripheral velocity of V0 in a portion without deformation, the peripheral velocity V1 in the portion of the pressure roll producing distortion $\epsilon 1$ in the circumferential direction is expressed by the following equation:

$$V1=V0(1+\epsilon 1)$$

The phenomenon in which the peripheral velocity of the heat-fixing roll in the portion that the pressure roll contacts occurs likewise even when the leading end of the recording sheet passes through the belt nip, and a slight deviation develops between the recording sheet 115 fed substantially at a velocity of V0 and the surface of the resilient layer 120. Therefore, the adhesion of the toner image 116 to the heat-fixing roll 101 is canceled and the recording sheet 115 strips off the heat-fixing roll 101. As the adhesion of the molten toner to the surface of the heat-fixing roll 101 is affected by the physical property of the chemical materials of both on the interface, the behavior of the recording sheet 115 which tends to strip off differs according to the kind of toner and the material quality of the resilient layer 120. In this fixing apparatus, however, the recording sheet can be stripped off the heat-fixing roll 101 without using a peel pawl normally employed in a fixing apparatus comprising a fixing apparatus and a pressure roll (hereinafter called self-stripping). In this fixing apparatus, moreover, thin paper difficult to strip off because of so-called weak nerve and paper with a large quantity of toner sticking thereto can also be self-stripped.

In order to ensure the self-stripping like this, the value of distortion $\epsilon 1$ in the circumferential direction is ought to be increased to a certain degree. When, however, great press contact force is applied to the pressure roll 103 to secure such distortion, the frictional force between the recording sheet 115 and the heat-fixing roll 101 in that portion increases, and the conveyance speed Vp of the whole recording sheet may become almost equal to the speed V1 of the portion where the distortion has developed. Then the peripheral speed of the heat-fixing roll 101 on the upstream side of the press-contact position of the pressure roll 103 substantially moves to V0 (the peripheral speed of the portion where no deformation is produced). The problem in this case is that the difference between the speed Vp of the recording sheet and the peripheral speed V0 of the heat-fixing roll causes a deviation on the contact face, which results in image aberration.

In consideration of the above problems, the apparatus disclosed in Japanese Unexamined Patent No. 150679/1993 is provided with the auxiliary pressure roll 106 disposed on the upstream side in the travel direction of the recording sheet with respect to the pressure roll 103 so as to press the auxiliary pressure roll 106 against the heat-fixing roll 101. Even when the leading end of the recording sheet 115 reaches the press contact position of the pressure roll 103 to exert the force of conveying the recording sheet at a speed almost equal to V1, the following portion of the recording sheet is pressed against a portion of the heat-fixing roll 101 moving substantially at the peripheral speed V0 to cancel the difference in speed between the heat-fixing roll 101 and the recording sheet 115. Image aberration is thus avoided.

When, however, the auxiliary pressure roll 106 is strongly pressed, compressional deformation is caused to the resilient layer of the heat-fixing roll 101 even in the portion against which the auxiliary pressure roll 106 is pressed as shown in FIG. 8, and distortion circumferentially develops in the peripheral surface in that portion.

When such a distortion develops, the peripheral velocity of the heat-fixing roll 101 becomes V3, which is greater than the peripheral velocity V0 of the portion without deformation, as in the press-contact position of the pressure roll 103 so as to exert the force of conveying the recording sheet at a speed greater than V0. Therefore, the frictional force base on the press contact force of the pressure roll and what is based on the press contact force of the auxiliary pressure roll make the recording sheet conveyance speed Vp almost equal to V1 or $V_3$. Consequently, there is produced the difference between the recording sheet conveyance speed Vp and the peripheral velocity V of the heat-fixing roll in the portion between the press-contact portion and the auxiliary pressure roll (an area A shown in FIG. 8), which results in image aberration.

In the case of a fixing apparatus in which pressure rolls for use in stretching a pressure belt along them is forced to be contact with a heat-fixing roll, on the other hand, there is a problem arising from ruining the luster of the image already fixed on one side of a recording sheet at the time another image is fixed on the other side when it is attempted to fix toner images successively on both sides thereof. The reason for this is considered attributable to the fact that the pressure roll is kept in press-contact with the heat-fixing roll having a built-in heating means via the pressure belt and is always heated at high temperatures. More specifically, the toner image already fixed on the one side of the recording sheet is heated again by the heat form the pressure roll when the image on the other side thereof is fixed, and the luster of the image on the one side is considerably changed as the toner image melts. When the toner image on the one side of the recording sheet melts, the trace of the joint of the pressure belt may be left thereon and in a case where the recording sheet is fusion-bonded to the pressure belt, the problem is that the recording sheet is not readily stripped off.

SUMMARY OF THE INVENTION

In view of the foregoing problems, an object of the present invention is to provide a belt-nip type fixing apparatus capable of not only preventing a recording sheet from sticking to the surface of a heat-fixing roll but also avoiding image aberration. Another object of the present invention is to provide a fixing apparatus capable of preventing the luster of an image fixed previously on one side of a recording sheet from being ruined when a toner image is fixed on both sides thereof, and also preventing any trace of a belt from being left on the image.

In order to solve the aforesaid problems, a fixing apparatus according to aspect 1 of the invention comprises built-in heating means, a heat-fixing roll which is driven to rotate, and an endless pressure belt which is stretched along a plurality of rolls and made to be contact and wound around the heat-fixing roll, wherein the heat-fixing roll is provided with a resilient layer on the peripheral surface; one of the plurality of rolls for stretching the pressure belt is a pressure roll which is located in a press contact portion where the pressure belt is forced to be contact with the heat-fixing roll on the downstream side in the direction of rotation of the heat-fixing roll and pressed against the heat-fixing roll so that the resilient layer of the heat-fixing roll undergoes compressional deformation; an auxiliary pressure roll is provided on the upstream side of the press contact portion and forced to be contact with the heat-fixing roll via the pressure belt; and a soft resilient layer formed of material not harder than what is used to form the resilient layer of the heat-fixing roll is formed on the peripheral surface of the auxiliary pressure roll.

According to aspect 2 of the invention, in the fixing apparatus according to aspect 1 thereof, the press contact force of the auxiliary pressure roll with respect to the heat-fixing roll is set so that the sum of the press contact force thereof and press contact force by the tension of the pressure belt made to be contact and wound around the heat-fixing roll is substantially equal to or greater than the pressing force of the pressure roll.

"Press contact force by the tension of the pressure belt" means the resultant force exerted in the direction of the center of the heat-fixing roll when the pressure belt introduced with tension is wound on the heat-fixing roll.

According to aspect 3 of the invention, in the fixing apparatus according to one of aspects 1 and 2 thereof, the distortion of the surface of the resilient layer in the circumferential direction, that is, the distortion resulting from forcing the auxiliary pressure roll to be contact with the heat-fixing roll is not greater than 0.5%.

According to aspect 4 of the invention, a fixing apparatus comprises built-in heating means, a heat-fixing roll which is driven to rotate, and an endless pressure belt which is stretched along a plurality of rolls and made to be contact and wound around the heat-fixing roll, wherein one of the plurality of rolls for stretching the pressure belt is a pressure roll which is pressed against the heat-fixing roll via the pressure belt; and the peripheral surface of the pressure roll is covered with a layer made of heat-resistant and heat-insulating material.

According to aspect 5 of the invention, in the fixing apparatus according to aspect 4 thereof, the heat-fixing roll is provided with a resilient layer on the peripheral surface thereof and the pressure roll is located on the downstream side of the press contact portion of the pressure belt in the direction of rotation of the heat-fixing roll and pressed against the heat-fixing roll so that the resilient layer of the heat-fixing roll undergoes compressional deformation.

According to aspect 6 of the invention, in the fixing apparatus according to aspect 5 thereof, the peripheral surface of the pressure roll is covered with a layer made of material harder than what is used for forming the resilient layer.

As the present invention in this patent application is configured as set forth above, it functions as follows:

In the fixing apparatus according to aspect 1, the resilient layer on the surface of the heat-fixing roll undergoes compressional deformation when the pressure roll is pressed against the heat-fixing roll and as shown in FIG. 1B, the velocity V1 of that portion pressed thereby is higher than the peripheral velocity V0 of the other portion (without the compressional deformation) of the heat-fixing roll. When the leading end of the recording sheet passed through the belt nip reaches a position where the pressure roll is forced to be contact the heat-fixing roll, the force exerted to convey the recording sheet at the velocity V1 acts because of the frictional force between the peripheral face of the heat-fixing roll and the recording sheet.

When, however, the auxiliary pressure roll is forced to be contact the heat-fixing roll so as to increase the frictional force between the peripheral face in that portion of the heat-fixing roll and the recording sheet, the auxiliary pressure roll is mainly deformed even though it is forced to be contact the heat-fixing roll because the auxiliary pressure roll is formed of resilient material softener than the resilient layer of the heat-fixing roll, and the distortion of the surface of the heat-fixing roll is restrained from becoming large in value as the distortion is dispersed. Therefore, the frictional force due to the press contact of the auxiliary pressure roll functions as what impedes the conveyance of the recording sheet at the high velocity V1, and the recording sheet is conveyed at a speed almost equal to the speed of the portion where no deformation of the heat-fixing roll is produced. Thus image aberration resulting from the deviation of the recording sheet from the surface of the heat-fixing roll is prevented. On the other hand, self-stripping is effected since the recording sheet is stripped off because of the difference between the peripheral velocity V1 of the heat-fixing roll and the recording sheet conveyance speed at the press-contact position of the pressure roll.

As the force of pressing the recording sheet against the peripheral face of the heat-fixing roll in the fixing apparatus above, the press contact force P1 of the pressure roll, the press contact force P2 by the tension of the pressure belt and the press contact force P3 of the auxiliary pressure roll can be taken into consideration as shown in FIG. 1B.

On the other hand, the distortion in the circumferential direction of the surface of the heat-fixing roll remains great at the press-contact position of the pressure roll, whereas it is suppressed at the other positions. Therefore, the frictional force accompanied by the press contact force P1 of the pressure roll becomes the force of feeding the paper at the high velocity V1, whereas the frictional force accompanied by the press contact force P2 by the tension of the pressure roll and the press contact force P3 of the auxiliary pressure roll works to feed the paper at a speed almost equal to the peripheral velocity V0 of the portion without distortion.

In the fixing apparatus according to aspect 2, further, the frictional force between the less distorted portion of the peripheral face of the heat-fixing roll and the recording sheet becomes predominant since the sum of the press contact force P2 by the tension of the pressure belt and the press contact force P3 of the auxiliary pressure roll is set equal to or greater than the press contact force P2 of the pressure roll, and the recording sheet is conveyed at a speed almost equal to the peripheral velocity V0 in the portion where no deformation of the heat-fixing roll is produced. Consequently, the recording sheet is substantially set free from shifting from the peripheral face of the heat-fixing roll and toner image aberration is avoided.

In the fixing apparatus according to aspect 3, since the distortion of the surface of the heat-fixing roll in the circumferential direction is not greater than 0.5% as the distortion results from forcing the auxiliary pressure roll to be contact the heat-fixing roll, the difference between the velocity V3 of the peripheral face of the heat-fixing roll in this portion and the velocity V0 in the portion without deformation is decreased. Even though the frictional based on the press contact force of the auxiliary pressure roll acts as what conveys the recording sheet at the velocity V3, the recording sheet conveyance speed Vp is not greatly different from the peripheral velocity V2 of the heat-fixing roll in the area A as shown in FIG. 1B, and the shifting of the recording sheet from the heat-fixing roll is kept small. It is therefore possible to suppress image aberration to an allowable extent. The critical value 0.5% has been proved recognizable from the test results which will be described later and besides not greater than 0.3% is preferable. Although this value cannot be 0.0% as long as the auxiliary pressure roll is forced to be contact the heat-fixing roll, any favorable result is attainable by minimizing it.

In the fixing apparatus according to aspect 4, the pressure roll pressed against the heat-fixing roll via the pressure belt has the peripheral face covered with the heat-resistant layer, whereby the quantity of heat transmitted from the heat source incorporated in the heat-fixing roll to the pressure roll is reduced. In other words, a great temperature gradient is produced by the coating layer provided on the peripheral face of the pressure roll, and a temperature rise in the pressure roll is decreased. When the recording sheet is fed between the heat-fixing roll and the pressure belt, the undersurface of the recording sheet is less heated by the heat accumulated in the pressure roll and even though the toner image already fixed on this side of the recording sheet exists, it is prevented from being melted again; this effect is achievable in the case where a toner image is fixed on both sides of the recording sheet. It is therefore possible to prevent image luster from being ruined by heating and melting again the toner image already fixed when another image is fixed on the other side of the recording sheet or the trace of the pressure belt from being left on the recording sheet sticking to the pressure belt.

In the fixing apparatus according to aspect 5, the resilient layer is formed on the peripheral face of the auxiliary pressure roll, and the pressure roll is pressed against the resilient layer of the heat-fixing roll so that the resilient layer thereof undergoes compressional deformation on the downstream side of the nip between the pressure belt and the heat-fixing roll. Consequently, circumferential distortion is produced on the surface of the resilient layer, and the release properties of the recording sheet with the toner image fixed on the recording sheet are improved. The pressure roll is supported in such a state that it is pressed against the heat-fixing roll and this makes the temperature of the whole pressure roll readily rise. However, the coating layer provided on the peripheral face of the pressure roll serves to suppress the temperature rise of the pressure roll, thus preventing the toner image on the one side of the recording sheet from deteriorating.

Although excellent heat-resistant materials are generally porous and easily deformable, the resilient layer is mainly deformed in the press-contact portion between the pressure roll and the heat-fixing roll by forming the coating layer of the pressure roll with a material harder than the resilient layer formed on the peripheral face of the heat-fixing roll, whereby the resilient layer is distorted in the circumferential direction. Thus excellent release properties are secured thereby.

DETAILED DESCRIPTION OF THE PREFERRED EMBODIMENTS

Figure 1A:
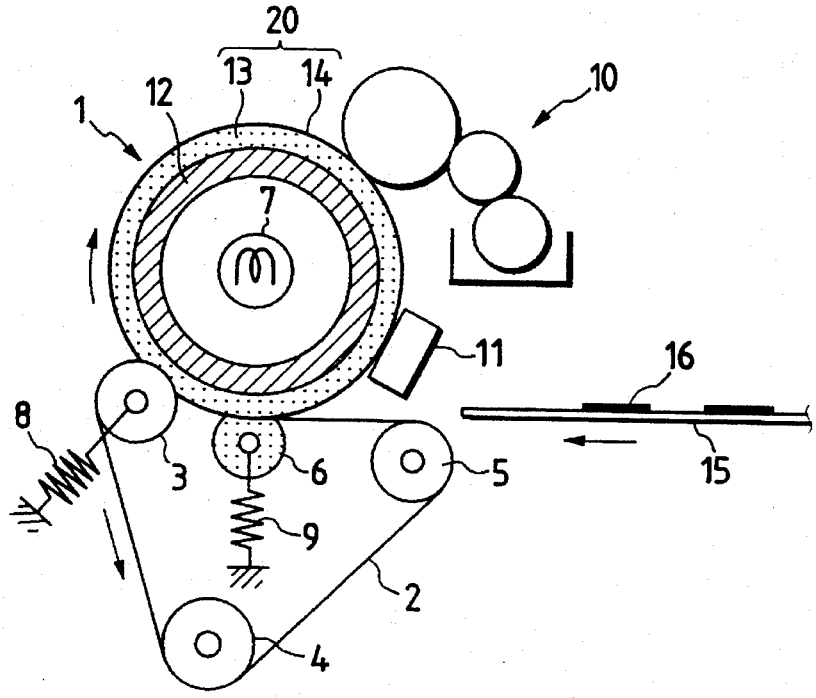
FIGS. 1A and 1B are a schematic diagram and a partial enlarged view of a fixing apparatus embodying the present invention.

Referring to the drawings, embodiments of the present invention will subsequently be described.

EMBODIMENT 1

Figure 1B:
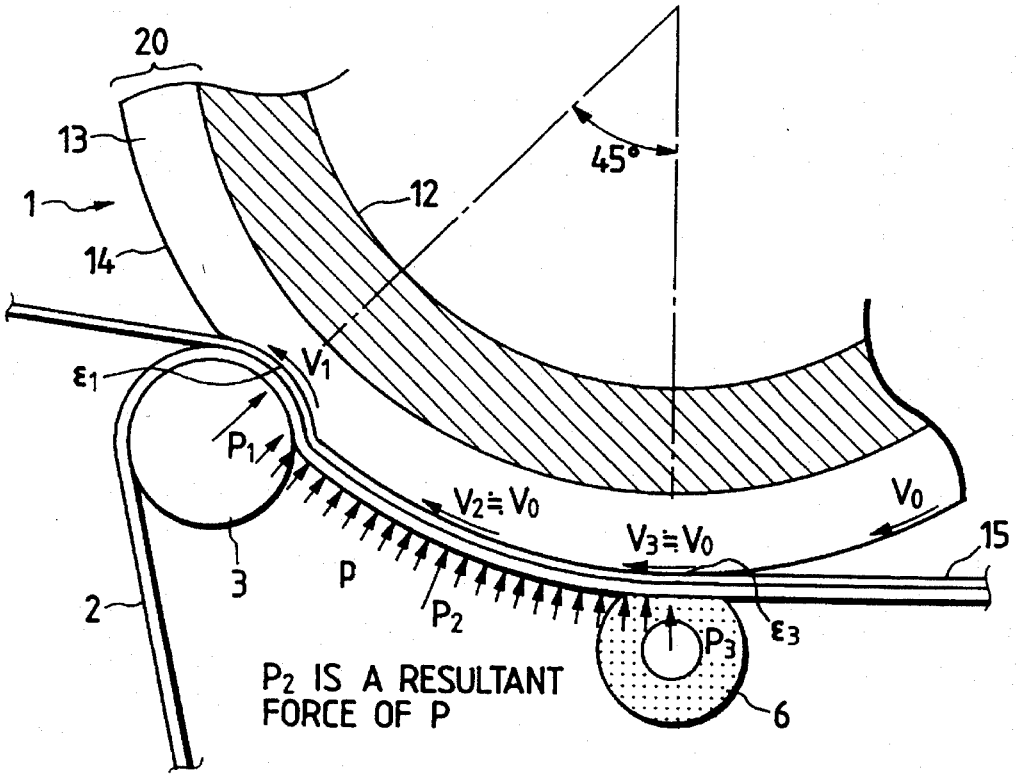

FIGS. 1A and 1B are schematic diagrams of a fixing apparatus as aspects 1–3 of the invention.

This fixing apparatus chiefly comprises a heat-fixing roll 1 having a built-in heat source, a pressure belt 2 not only stretched along a pressure roll 3 and two support rolls 4, 5 but also forced to contact the heat-fixing roll 1, and an auxiliary pressure roll 6 pressed against the heat-fixing roll 1 via the pressure belt 2.

The heat-fixing roll 1 is made by forming a resilient layer 20 around a metal core 12, which is an aluminum cylindrical body 46 mm in outer diameter and 40 mm in inner diameter. The surface of the core 12 is covered directly with HTV silicone rubber as a primary layer 13 which is 45° in hardness (JIS-A) and 2 mm thick, and with RTV silicone rubber as a topcoat 14 formed by dip coating thereon, the topcoat 14 being 2 μm thick. The primary layer 13 and the topcoat 14 constitute the resilient layer 20, and the surface of the topcoat 14 is substantially mirror-finished. Incidentally, the hardness of the primary layer 13 has been obtained as a result of measuring the coat by means of a Teclock Company's spring A-type durometer and by pressing the measuring instrument vertically against test pieces with a load of 1,000 gf in conformity to JIS K6301. Hereinafter, hardness according to any other similar measuring method will be simply called JIS-A.

The output of a halogen lamp 7 as a heat source is 400 w, and a temperature controller (not shown) has feedback control over the halogen lamp 7 according to a signal from a temperature sensor 11 so as to adjust the temperature on the surface of the heat-fixing roll 1 to 150° C. Moreover, dimethyl silicone oil (KF - 96 of Shin-Etsu Chemical Co., Ltd.) having a viscosity of 300 cs is used as a parting agent to be supplied by an oil supply unit 10.

On the other hand, a polyimide film is used for forming the pressure belt 2 which is 75 μm thick, 300 mm wide and 188 mm in perimeter. The pressure belt 2 is wound over the support rolls 4, 5 and the pressure roll 3 with a tension of 10 Kgf. The pressure roll 3 and the support rolls 4, 5 are made of stainless steel and have diameters of 20 mm, 20 mm and 18 mm, respectively. Each of these rolls is tapered so that the diameter in the central portion is slightly greater than the diameter in the end portion. In other words, the pressure belt 2 is kept flat even when the tension of the pressure belt 2 causes the rolls 3, 4, 5 to be distorted, so that it is allowed to run smoothly without waving. The pressure roll 3 out of those rolls is urged by a compression coil spring 8 toward the center of heat-fixing roll 1 with a constant load, whereby part of the pressure belt 2 is forced to be contact and wound round the heat-fixing roll 1.

The pressure belt 2 is wound round the heat-fixing roll 1 over an arc of 45° and a nip width of 19.6 mm (in the longitudinal direction of the belt) while the auxiliary pressure roll 6 is separated from the pressure belt 2. Since the pressure roll 3 is made of stainless steel and far harder than the resilient layer 20 of the heat-fixing roll 1, the pressure roll 3 causes the resilient layer 20 of the heat-fixing roll 1 to produce a distortion $\epsilon 1$ in the circumference direction. Incidentally, the axis of the support roll 4 is slightly tilted from a position parallel to the other rolls and is made slightly movable; in other words, the position of the belt in the width direction is to be corrected by managing the axial position and angle of the support roll 4.

On the other hand, the auxiliary pressure roll 6 situated on the upstream side of the travel direction of a recording sheet 15 with respect to the pressure roll 3 is prepared by covering a stainless core 13 mm in diameter with a 5 mm-thick surface layer (a soft resilient layer) of silicone sponge (foamed material of silicone rubber). The auxiliary pressure roll 6 is also urged by a compression coil spring 9 from the inside of the pressure belt 2 toward the center of the heat-fixing roll 1. However, the surface layer of the auxiliary pressure roll is primarily deformed in the pressing portion because the surface layer is formed of material softener than the resilient layer 20 of the heat-fixing roll 1, and the distortion $\epsilon 3$ of the resilient layer 20 is decentralized to the extent that it has a small value. In this case, the axis-to-axis distance between the pressure roll 3 and the auxiliary pressure roll 6 is 25.5 mm, whereas the nip width resulting from installing the auxiliary pressure roll 6 is 21.8 min.

Figure 2:
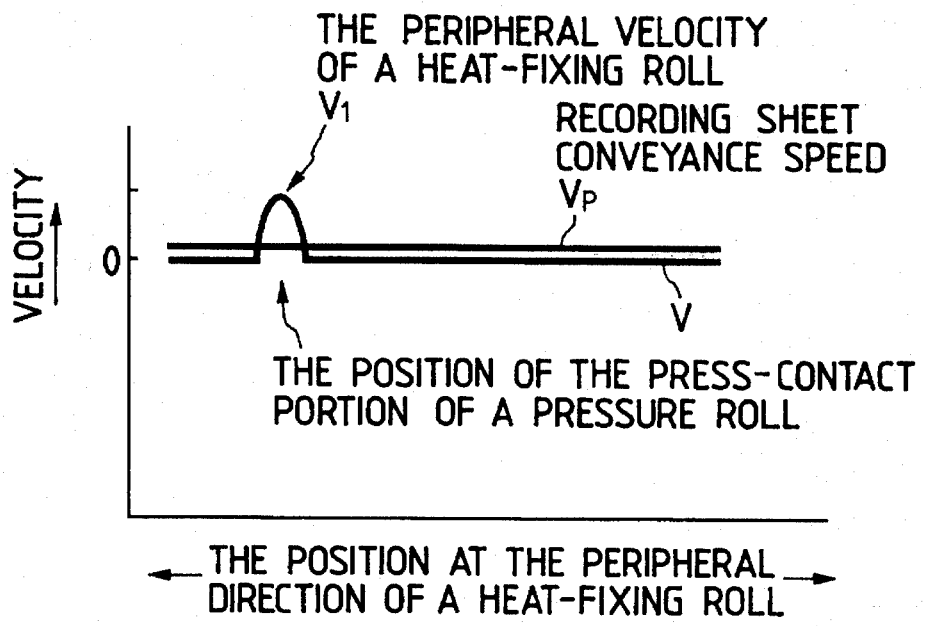
FIG. 2 is a chart showing the distribution of the peripheral velocity of the heat-fixing roll and recording sheet conveyance speed in the fixing apparatus of FIG. 1.

In the fixing apparatus like this, the heat-fixing roll 1 is driven by a motor to rotate at a peripheral velocity of V0=160 mm/sec and as the heat-fixing roll 1 rotates, the pressure belt 2 is also made to move circumferentially at substantially the same velocity. When the recording sheet 15 carrying an unfixed toner image 16 is fed in between the heat-fixing roll 1 and the pressure belt 2, the recording sheet 15 held therebetween is conveyed. Then the recording sheet 15 is, as shown in FIG. 1B, pressed against the peripheral face of the heat-fixing roll 1 due to press contact force P2 resulting from the tension of the belt and the press contact force P3 of the auxiliary pressure roll. As shown in FIG. 2, further, the recording sheet 15 is made to move at a velocity close to the peripheral velocity V0 (the peripheral velocity while no peripheral distortion is caused to the resilient layer) of the heat-fixing roll 1. Subsequently, the toner image 16 is fused because of heat from the heat-fixing roll 1 before being forced to adhere to the recording sheet 15.

As the distortion $\epsilon 1$ in the circumferential direction has been caused to the resilient layer 20 in a portion where the pressure roll 3 is forced to contact the heat-fixing roll 1, moreover, a peripheral velocity V1 on the surface of the resilient layer in that portion has become greater than the velocity in any other portion; therefore, there develops a very small deviation with respect to the recording sheet 15 and this results in the stripping of the recording sheet 15.

In the fixing apparatus like this, the recording sheet 15 is fed at a peripheral velocity higher than that of any other portion due to the frictional force based on the press contact force P1 of the pressure roll 3 and image aberration may occur. A description will subsequently be given of the results of the tests carried out to find out the conditions under which such image aberration can be prevented.

The tests were intended to find out the critical point at which the image aberration was brought about by varying the press contact force P1 of the pressure roll 3 and the press contact force $P_3$ of the auxiliary pressure roll 6. As the auxiliary pressure roll in that case, what had a surface layer of silicone sponge whose rubber hardness was 23°. The rubber hardness was based on examining test pieces by pressing a sponge rubber durometer of Ascar C-type of Kobunshi Kagaku Company against them with a load of 300 gf. Ascar C is hereinafter given to any value obtained under the same measuring method.

The pressure contact force of the pressure roll 3 and the auxiliary pressure roll 6 was caused to vary by changing the positions where the compression coil springs 8, 9 were supported and the toner image was fixed on each condition. Further, the presence or absence of image aberration was examined by observing the toner image fixed on a recording sheet. A4 paper 82 g/m$^2$ in basis weight was used as the recording sheet.

Table 1 shows the test results.

TABLE 1

| Press contact force of auxiliary pressure roll | Press contact force of tension of belt | (1) + | Press contact force of pressure roll (Kgf) | | |
|---|---|---|---|---|---|
| (Kgf) (1) | (Kgf) (2) | (2) | 8 | 16 | 24 |
| 0 | 7.7 | 7.7 | Δ | X | X |
| 5 | 7.7 | 12.7 | O | O | X |
| 8 | 7.7 | 15.7 | O | O | Δ |
| 10 | 7.7 | 17.7 | O | O | Δ |
| 20 | 7.7 | 27.7 | O | O | O |

Figure 3A:
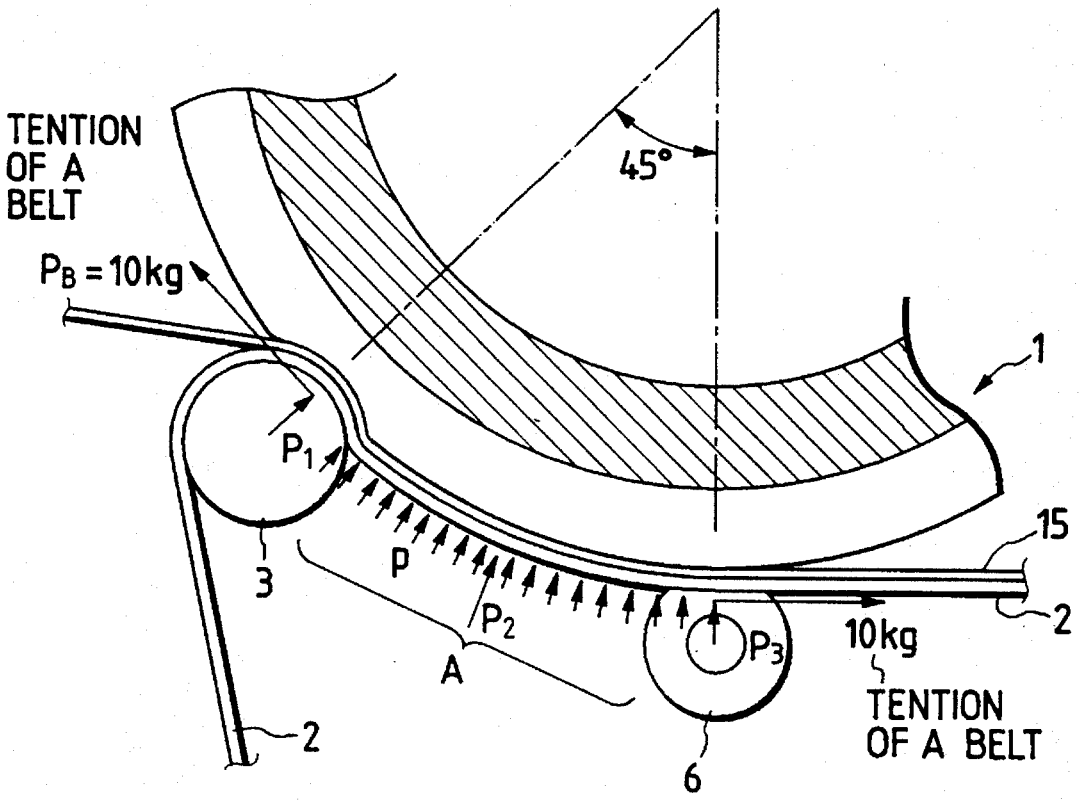
FIGS. 3A and 3B are diagrams illustrating the force of pressing the recording sheet against the heat-fixing roll in the fixing apparatus of FIG. 1.
Figure 3B:
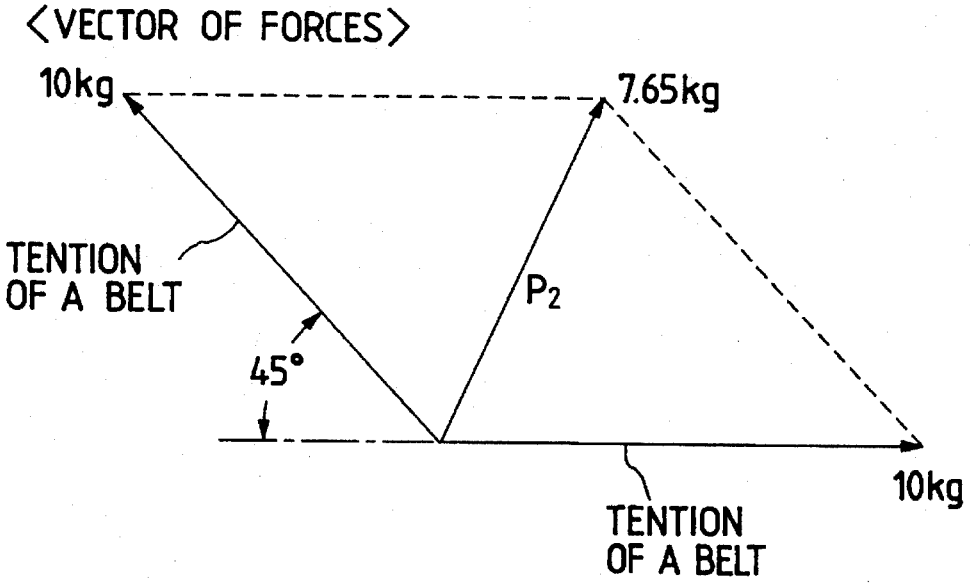

As shown in Table 1, the press contact force P2 applied by the tension of the pressure belt 2 is force which acts in the direction of the center of the heat-fixing roll 1 as the pressure belt is wound on the heat-fixing roll 1 as shown in FIG. 3, and was calculated as the resultant force distributed and acting between the pressure roll 3 and the auxiliary pressure roll 6 (area A). Further, the mark x in Table 1 indicates that visually recognizable image aberration appeared on the recording sheet; Δ indicates that image aberration recognizable when the image was magnified, though visually unrecognizable, appeared thereon; and O indicates that no image aberration appeared even when the image was magnified and that the image was in the best condition.

Generally speaking, the greater the press contact force of the auxiliary pressure roll 6, the less the image aberration occurs as shown in Table 1. When the extent to which the image remains unrecognizable unless it is magnified as shown by the mark Δ is assumed a allowable range, substantially good results were obtained through only the tension of the pressure belt without the press contact force of the auxiliary pressure roll when the press contact force of the pressure roll was 8 Kgf. When the load applied to the pressure roll was 16 Kgf, it was impossible to prevent image aberration exceeding the allowable range unless the sum of the press contact force P2 due to the tension of the pressure belt and the press contact force $P_3$ of the auxiliary pressure roll was 12.7 Kgf or greater. In order to obtain a still better image, P2+P3 has to be 15.7 Kgf which is substantially equal to the press contact force P1 of the pressure roll. When the press contact force of the pressure roll was 24 Kgf, substantially good results were obtained through a resultant force P2+P3 of 15.7 Kgf, and still better results were obtained through that of 27.7 Kgf.

Thus a good image free from image aberration is seen to be available by setting the force P3 in forcing the auxiliary pressure roll 6 to be contact the heat-fixing roll 1 equal to or greater than the force P1 in forcing the pressure roll and the heat-fixing roll to be contact with each other by means of the resultant force P2+P3 with the tension of the pressure belt.

Subsequently, additional tests were made to examine image aberration on recording sheets when distortion in the circumferential direction of the surface of the heat-fixing roll was varied by setting constant the press contact force P1 applied to the pressure roll and changing the press contact force P2 applied to the material of the surface layer of the heat-fixing roll by the auxiliary pressure roll.

In that case, the press contact force P1 applied to the pressure roll was set to 16 Kgf. In addition, four kinds of surface layers of auxiliary pressure rolls were prepared; namely, surface layers formed of (Ascar-C) silicone sponge having a hardness of 20° and a hardness of 35°, and those formed of (JIS-A) silicone rubber having a hardness of 20° and a hardness of 35°. These four kinds were selected from materials softener than the resilient layer of a heat-fixing roll having a rubber hardness of 45° (JIS-A). This arrangement was made to prevent not only the deformation of the resilient layer as much as possible due to the press contact of the auxiliary pressure roll but also the fluctuation of velocity between the entrance and midway of the belt nip. Notwithstanding the selection of the surface area like that, distortion $\epsilon_3$ will also be caused to the resilient layer if the press contact force given by the auxiliary pressure roll and the hardness of the surface layer are great. In these tests, the distortion $\epsilon 3$ of the resilient layer was measured and the relation between the distortion $\epsilon 3$ and image aberration was considered.

Table 2 shows the test results, indicating the relation between the distortion $\epsilon 3$ in the circumferential direction of the resilient layer and image aberration.

TABLE 2

| Presss contact force of auxiliary pressure roll (Kgf) | Press contact force by tension of belt (Kgf) | (1) + (2) | Si sponge hardness 20° (Ascar-C) Image aberration | Si sponge hardness 20° (Ascar-C) Distort $\epsilon_3$% | Si sponge hardness 35° (Ascar-C) Image aberration | Si sponge hardness 35° (Ascar-C) Distort $\epsilon_3$% | Si rubber hardness 20° (JIS-A) Image aberration | Si rubber hardness 20° (JIS-A) Distort $\epsilon_3$% | Si rubber hardness 35° (JIS-A) Image aberration | Si rubber hardness 35° (JIS-A) Distort $\epsilon_3$% |
|---|---|---|---|---|---|---|---|---|---|---|
| 0 | 7.7 | 7.7 | X | 0 | X | 0 | X | 0 | X | 0 |
| 5 | 7.7 | 12.7 | Δ | 0.1 | Δ | 0.1 | Δ | 0.2 | Δ | 0.5 |
| 8 | 7.7 | 15.7 | O | 0.1 | O | 0.2 | Δ | 0.4 | X | 0.7 |
| 10 | 7.7 | 17.7 | O | 0.1 | O | 0.2 | Δ | 0.5 | X | 0.9 |
| 20 | 7.7 | 27.7 | O | 0.2 | O | 0.8 | X | 1.0 | X | 2.0 |

The distortion $\epsilon_2$ was examined as follows:

Only the auxiliary pressure roll was made to be contact with the pressure belt and the length of the recording sheet fed by one turn of the heat-fixing roll was measured. This length is referred to as the "deformed circumference" of the heat-fixing roll. Further, the circumference of the heat-fixing roll is referred to as the "undeformed circumference" when in such a state that no distortion was caused to the resilient layer, and the following equation was used to calculate the distortion $\epsilon_2$:

$$\epsilon_3 = \left( \frac{\text{deformed circumference}}{\text{undeformed circumference}} - 1 \right) \times 100[\%]$$

The hardness of the silicone sponge in that testing was measured by the sponge rubber durometer of Ascar-C type, and the hardness of the silicone rubber was based on JIS K6301. The measured value of one and the same object according to JIS K6301 was smaller than what was obtained by the sponge rubber durometer of Ascar-C type. In Table 2, those actually having higher hardness are shown on the right-hand side, and those actually having lower hardness on the left-hand side.

Further, the marks O, Δ,x indicative of the conditions of image aberration in Table 2 conform to the definitions given in Table 1.

As is obvious from Table 2, the greater the press contact force of the auxiliary pressure roll, the greater the distortion ϵ3 also becomes. Moreover, the harder the surface area of the auxiliary pressure roll, the greater the distortion ϵ3 becomes. In other words, the distortion ϵ3 in the circumferential direction of the resilient layer of the heat-fixing roll is kept small in value when the soft surface layer of the auxiliary pressure roll is forced to be contact with the resilient layer and deformed; that is, no image aberration is caused on condition that the sum of the press contact force P2 by the tension of the pressure belt and the press contact force P3 of the auxiliary pressure roll is equal to or greater than the press contact force P1 of the pressure roll. A good image is thus obtained.

As the hardness of the surface layer of the auxiliary pressure roll becomes higher and as the press contact force P3 of the auxiliary pressure roll becomes greater, however, the distortion ϵ3 in the circumferential direction of the resilient layer increases and image aberration is caused when this value exceeds 0.5%. In order to obtain a still better image, it is preferred to set the distortion in the circumferential direction to 0.3% or less.

In other words, image aberration is caused because of the distortion ϵ3 of the resilient layer when not only the hardness of the surface layer of the auxiliary pressure roll but also the press contact force of the auxiliary pressure roll is great. The load given by the auxiliary pressure roll to the heat-fixing roll is desired to be greater in view of holding down the recording sheet. If the load is too great, the resilient layer will be deformed and image aberration will be caused accordingly.

EMBODIMENT 2

A description will subsequently be given of a heat-fixing roll as aspects 5 or 6 of the present invention.

Figure 4A:
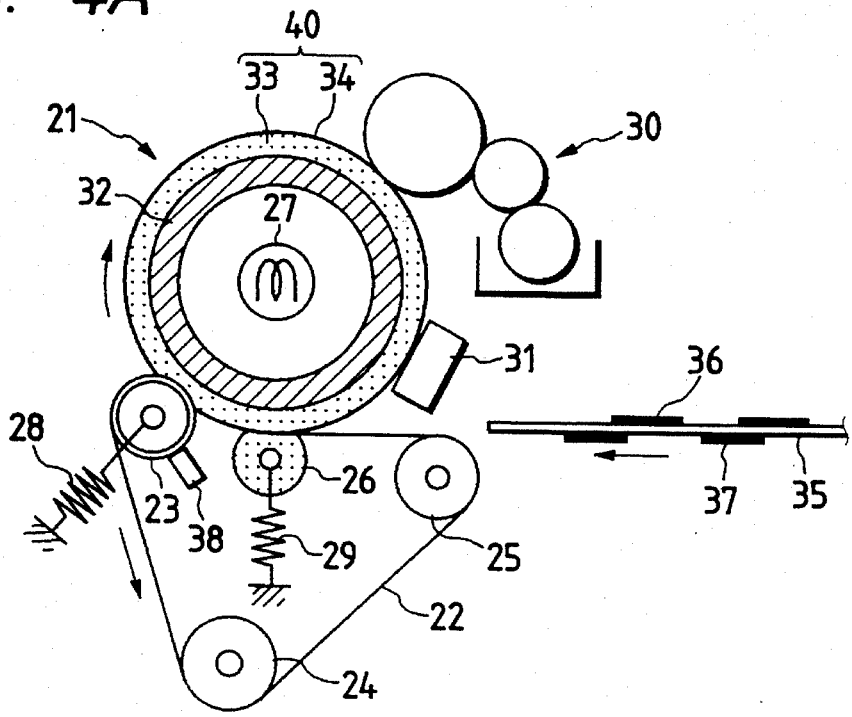
FIGS. 4A and 4B are a schematic diagram and a partial enlarged view of another fixing apparatus embodying the present invention.
Figure 4B:
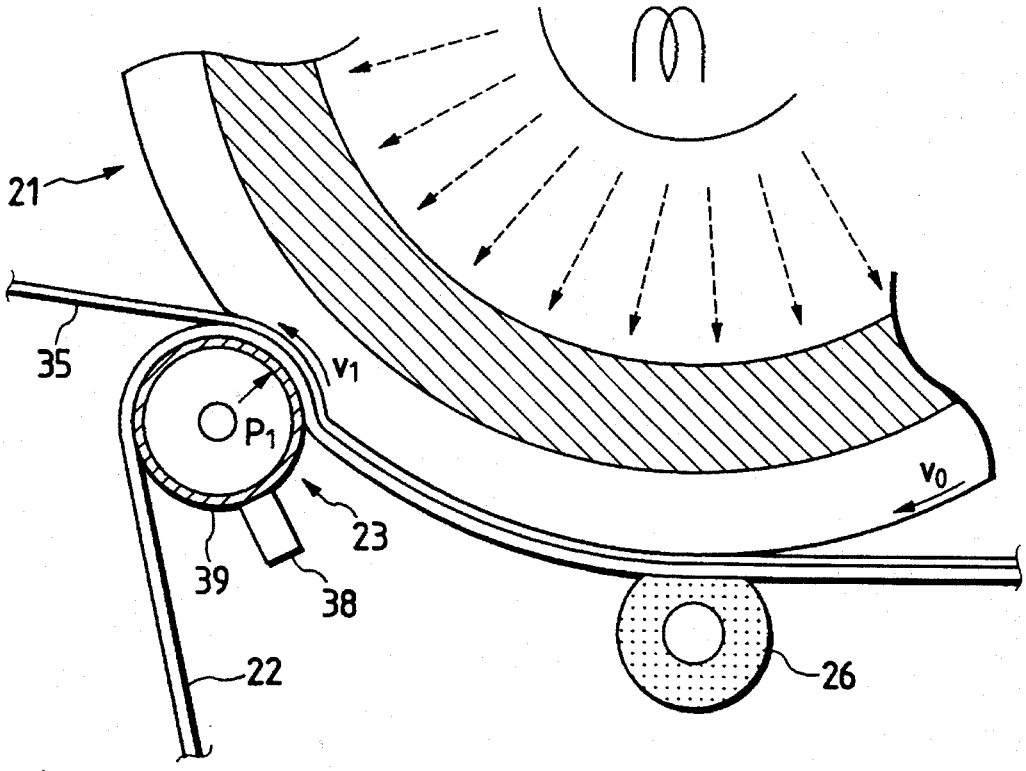

FIG. 4A is a schematic diagram of this fixing apparatus.

As shown in FIG. 4A, the construction of this fixing apparatus and that of the fixing apparatus shown in FIG. 1 are basically common to each other. This fixing apparatus comprises a heat-fixing roll 21 having a built-in heat source, a pressure belt 22 stretched along a pressure roll 23 and two support rolls 24, 25, and an auxiliary pressure roll 26 pressed against the heat-fixing roll via the pressure belt 22.

The core 32 of the heat-fixing roll 21 is an aluminum cylindrical body 47 mm in outer diameter and 42 mm in inner diameter, and a resilient layer 40 formed around the core includes a primary layer 33 which is 1.5 mm thick and a topcoat 34 which is 2 μm thick and formed by dip coating.

A heat source 27 that the heat-fixing roll 21 incorporates is a halogen lamp whose output is 850 W and subjected to ON/OFF control according to a signal from a temperature sensor 31.

The pressure belt 22 is similar to what is employed in the fixing apparatus of FIG. 1 and formed with an endless polyimide film 75 μm thick.

The support rolls 24, 25 are made of stainless steel and are both 18 mm in diameter. Further, the auxiliary pressure roll 26 is prepared by covering the stainless core 13 mm in diameter with a 5 mm-thick surface layer of silicone sponge having a hardness of (Ascar-C) 23°.

The pressure roll 23 which is different from what is shown in FIG. 1 is formed by covering the surface of a columnar aluminum body 23 mm in diameter with a heat insulating layer 39. The heat insulating layer 39 is formed of fluoroplastics 0.25 mm thick through the following steps.

In order to improve adhesion, the surface of the columnar aluminum body as the core is sandblasted and a heat-resistant primer is applied thereto. Then the aluminum body is fitted into a heat-shrinkable fluoroplastic tube to form the heat insulating layer 39 by making the heat-shrinkable tube adhere to the columnar body.

For the heat insulating layer 39, the following materials in addition to fluoroplastics may be used: rubber-like resilient materials such as silicone rubber, fluororubber, acrylic rubber, butyl rubber, nitrile rubber, EPDM rubber and High Parlon; and resins such as silicone resin, phenol, melamine resin, polyethylene resin, polypropylene resin, polystyrene resin, polyacetal resin, polyamide resin, polyester resin, polyacrylic resin, polycarbonate resin, polysulfone resin, polyethersulfon resin, polyarylate resin, polyimide resin and triazine resin. These materials are at least resistant to heat at 180° C.

However, any material usable for the heat insulating layer 39 is what has a hardness of 45° (JIS-A). This is because such a hardness of 45° or greater allows the resilient layer 40 of the heat-fixing roll 21 to produce great compressional deformation when the pressure roll 23 is pressed against the heat-fixing roll 21, and the distortion $\epsilon 1$ effectively in the circumferential direction of the surface. The distortion $\epsilon 1$ makes the aforementioned self-stripping possible.

The fixing apparatus is controlled so that the surface of the heat-fixing roll whose temperature is measured by the temperature sensor 31 has a temperature of 160° in the standby condition in which no toner image is fixed. The temperature of the surface of the pressure roll 23 is measured by a temperature sensor 38 at this time and the temperature of the surface thereof is kept stable at 90° C. because of heat transmission from the heat-fixing roll 21.

Figure 5:
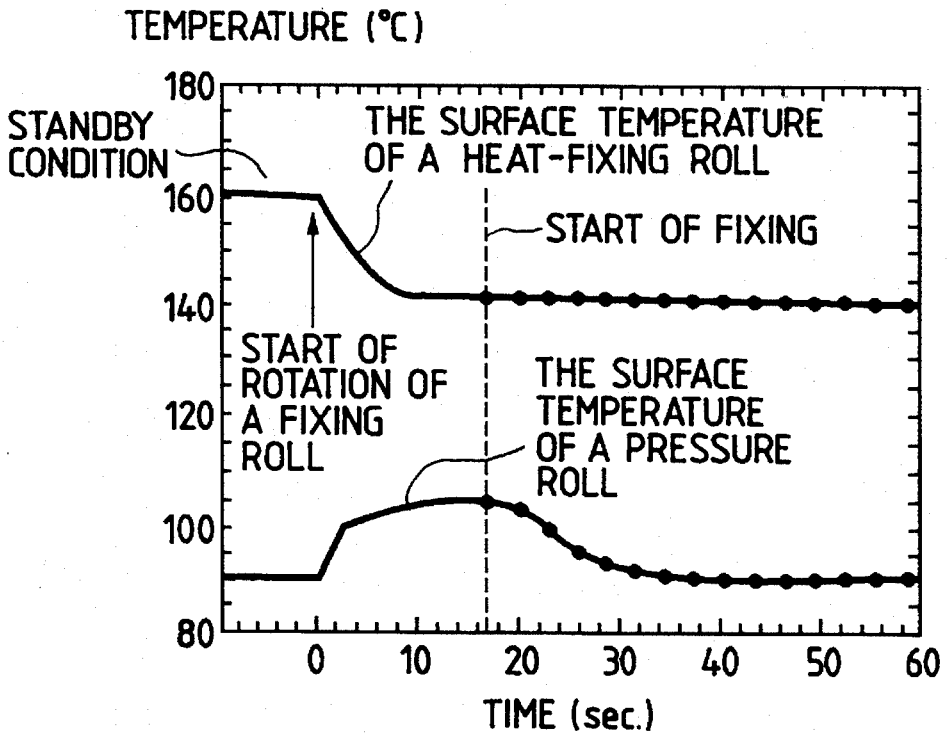
FIGS. 5 is a chart showing the results of measuring temperatures on the surface of the heat-fixing roll and that of the pressure roll in the fixing apparatus of FIG. 4.

When the fixing operation is performed, the heat-fixing roll 21 is driven to rotate at a peripheral velocity of $V0=160$ mm/sec, and a recording sheet 35 carrying an unfixed toner image 36 is fed into the press contact portion between the heat-fixing roll 21 and the pressure belt 22. As heat is taken away from the heat-fixing roll 21 by an oil supply unit 30 and the pressure belt 22 then, the surface temperature of the heat-fixing roll 21 lowers by about 20° C. to 140° as shown in FIG. 5. The surface temperature of the heat-fixing roll 21 is maintained at substantially 140° C. by a temperature controller from this point of time up to the termination of the fixing operation.

On the other hand, the peripheral surface of the pressure roll 23 is uniformly heated when the pressure roll 23 begins to rotate as the pressure belt 22 is driven, and the surface temperature measured by the temperature sensor 38 rises up to about 105° C. When toner-image fixing is started, further, the heat of the pressure roll 23 is taken away by the recording sheet and the surface temperature thereof lowers to about 90° C.

A description will subsequently be given of the results of tests made to examine the condition of luster when a toner image is fixed on both sides of a recording sheet in the fixing apparatus like this.

In this testing, the above fixing apparatus was applied to a copying machine capable of duplex copying. A toner image was formed and fixed on one side of the recording sheet first, and then the luster of the image was measured (first measurement). Further, a toner image was formed and fixed on the other side of the recording sheet, and the luster of the image fixed on the one side thereof was measured again (second measurement) to compared this and the preceding values.

When the toner image was fixed on both sides of the recording sheet, the image on the other side thereof was equivalent to what had been intended for measurement at first and in a case where there was a difference in measured value between the first and second measured values, this means that the luster of the one side was different from that of the other side when such a toner image was formed on both sides.

In the testing above, the toner used was what melts at 125° C. Moreover, a glossmeter of Gardener Co., (75°–75° Glossmeter Meter II) was employed for the measurement of luster therein.

The test results showed that the variation of luster of the image fixed in the fixing apparatus according to the present invention was so small as to range within ±1 in terms of the value read by the glossmeter above. As long as the image on the one side was concerned, moreover, there arose no problems including leaving the trace of the joint of the pressure belt 22 on the one-side image as a defect, and allowing the recording sheet 35 sticking to the pressure belt 22 to break away therefrom. This indicates that since the surface temperature of the pressure roll has been suppressed sufficiently in comparison with the molten temperature of the toner, the toner of the image formed on the one side is prevented from being excessively heated and melted again accordingly.

Figure 6:
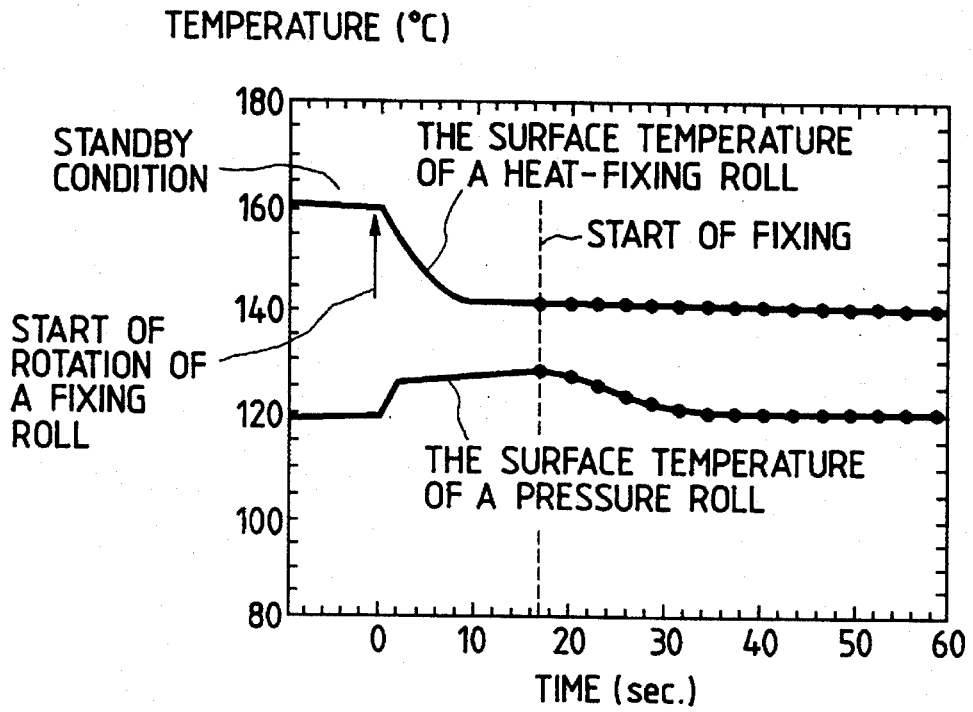
FIG. 6 is a chart showing the surface temperatures of a heat-fixing roll and a pressure roll in a conventional fixing apparatus to compare these temperatures with the results of FIG. 5.
Figure 7:
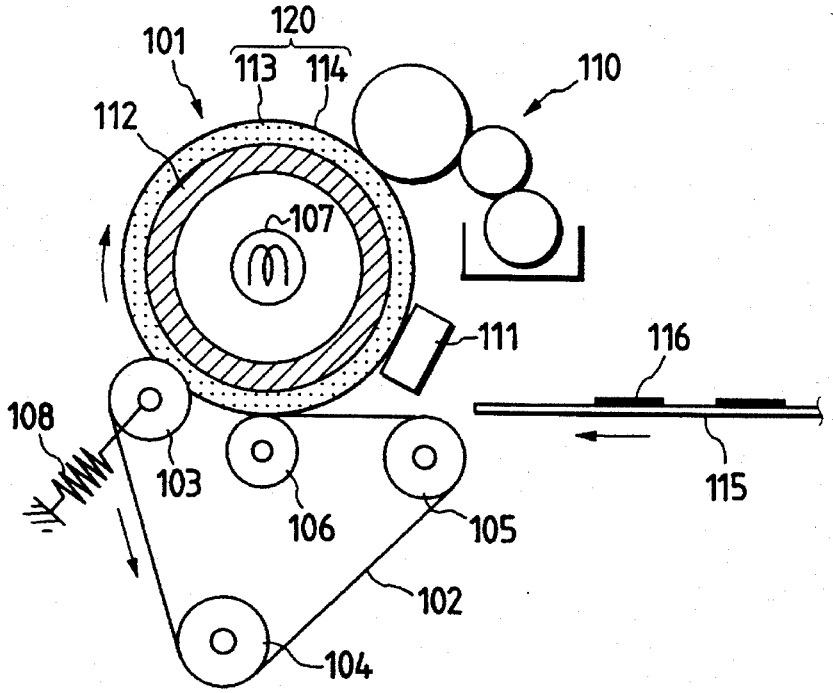
FIG. 7 is a schematic block diagram of a convention fixing apparatus.
Figure 8:
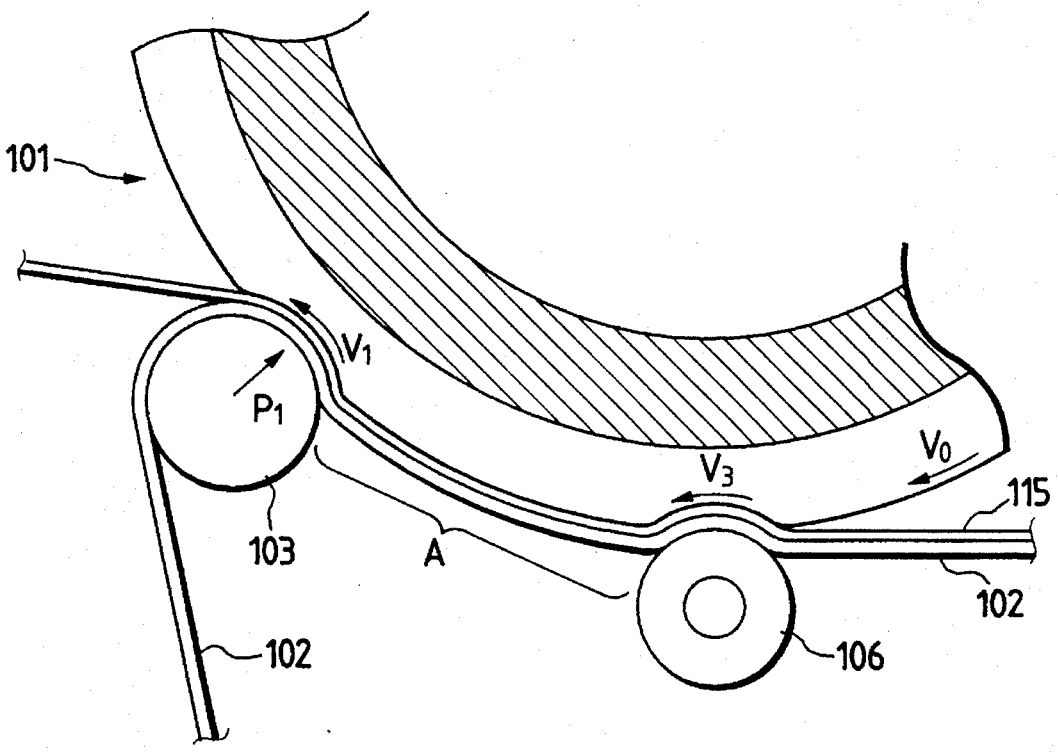
FIG. 8 is a schematic sectional view illustrating problems arising from the conventional fixing apparatus.
Figure 9:
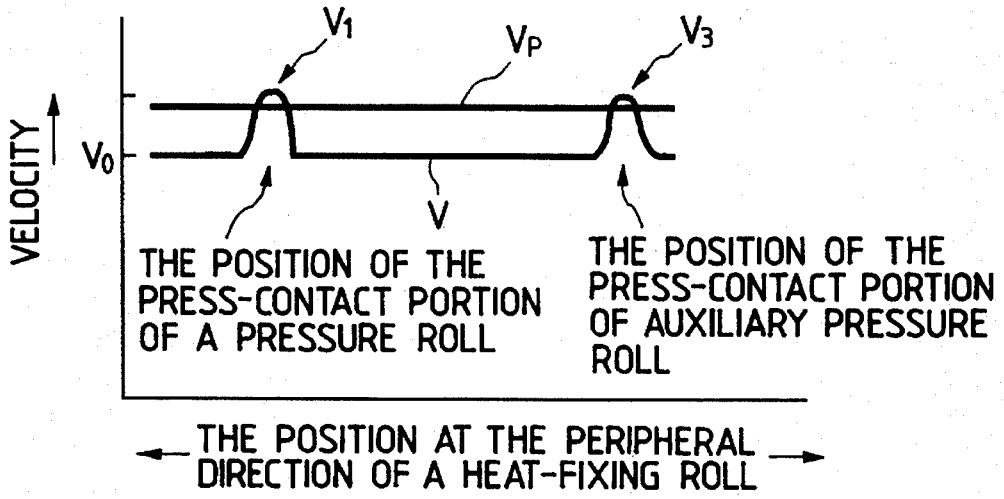
FIG. 9 is a chart showing the distribution of the peripheral velocity of the heat-fixing roll and recording sheet conveyance speed in the conventional fixing apparatus.

Subsequently, similar testing was carried out in a fixing apparatus using an aluminum pressure roll without a heat insulating layer on the surface as a comparative example. FIG. 6 shows variations in temperature in this apparatus. Since the heat insulating layer was not provided in the comparative example, a great deal of heat was transmitted from the heat-fixing roll and the temperature of the pressure roll in the standby condition reached 120° C.

When the heat-fixing roll was rotated in that condition, the temperature of the pressure roll came up to 130° C. uniformly. In other words, the surface temperature of the pressure roll increased by even 25° C. in the comparative example when the fixing operation was started and the melting temperature of toner also exceeded 125° C.

The fixing apparatus was applied to a copying machine capable of duplex copying like the embodiment of the present invention and an image was formed on both sides of a recording sheet. Further, the luster of the image on one side of the recording sheet was examined before and after the image was formed on the other side thereof likewise. The test result showed that the variation of image luster increased by +10 in the value read from the glossmeter above and the difference became recognizable. Moreover, a trace originating from the joint of the pressure belt was left on the image on the one side of the recording sheet. When a large quantity of toner is present in the vicinity of the leading end of the recording sheet, the recording sheet stuck to the pressure belt and was not stripped off. This was because the surface temperature of the pressure roll became too high, thus melting the toner of the image formed on the one side of the recording sheet again.

Further, the variation of image luster was examined at a different temperature of the pressure roll when the fixing operation was started by varying the material quality of the core of the pressure roll or the material quality and thickness of the heat insulating layer. Table 3 shows the test results, wherein the difference (G2–G1) between glossness G1 (%) on one side of the recording sheet after the fixing operation on the one side thereof and glossness G2 (%) on the one side thereof after the fixing operation on the other side is made to correspond to the temperature of the pressure roll when the fixing operation is started.

TABLE 3

| Surface temperature of heat-fixing roll: 140° | Surface temperature of pressure roll when fixing operation is started | | | | | |
|---|---|---|---|---|---|---|
| | 90° | 100° | 110° | 120° | 130° | 140° |
| Variation of image luster | −0.8 | +0 | +1 | +3 | +10 | +12 |

As is obvious from Table 3, the lower the surface temperature of the pressure roll, the less the variation of image luster becomes. In this case, the variation of image luster at not greater than +5 is preferred and it can be not greater than +5 actually by setting the surface temperature of the pressure roll equal or not greater than the softening temperature (softening point of toner: 115° C.) of toner. Moreover, it is possible to avoid inconvenience such as a defective image resulting from the presence of the trace of the joint of the pressure belt thereon and from the recording sheet 15 fusion-bonded to the pressure belt 22 to the extent that the former is difficult to strip off. As the test results revealed, the provision of the heat insulating layer on the pressure roll is effective in suppressing the surface temperature of the pressure roll.

As set forth above, the following effect is achievable by the fixing apparatus according to the present invention.

In the fixing apparatus according to aspect 1, self-stripping is made possible since the pressure roll is forced to be contact with the heat-fixing roll having the resilient layer to prevent the recording sheet from sticking to the surface of the heat-fixing roll. Since the auxiliary pressure roll having the soft resilient layer on the peripheral face is pressed against the heat-fixing roll via the pressure belt, moreover, the recording sheet is prevented from shifting from the peripheral face of the heat-fixing roll as the pressure roll is forced to be contact with the heat-fixing roll. Thus image aberration is avoided.

In the fixing apparatus according to aspect 2, the recording sheet is prevented from being pulled at the peripheral velocity of the press-contact portion of the pressure roll and from being conveyed at a speed higher than the peripheral velocity of any other portion of the heat-fixing roll since the sum of the press contact force P2 by the tension of the pressure belt and the press contact force P3 of the auxiliary pressure roll is set equal to or greater than the press contact force $P_1$ of the pressure roll, whereby image aberration because of the shifting of the recording sheet from the peripheral face of the heat-fixing roll is restrained.

In the fixing apparatus according to aspect 3, the press contact force of the auxiliary pressure roll effectively acts as what prevents the recording sheet from being conveyed at a speed higher than the peripheral velocity of the heat-fixing roll since the distortion of the surface of the heat-fixing roll in the circumferential direction is not greater than 0.5% as the distortion results from forcing the auxiliary pressure roll to be contact with the heat-fixing roll. Therefore, image aberration because of the shifting of the recording sheet from the peripheral face of the heat-fixing roll is restrained.

In the fixing apparatus according to aspect 4, the quantity of heat transmitted from the heat-fixing roll to the pressure roll is restricted since the pressure roll pressed against the heat-fixing roll via the pressure belt has the peripheral face covered with the heat-resistant layer. When a toner image is fixed on both sides of the recording sheet, it is possible to avoid any inconvenience arising from ruining image luster by heating and melting again the toner image already fixed on the one side of the recording sheet or allowing the trace of the pressure belt to be left on the one side of the recording sheet or causing the recording sheet to stick to the pressure belt.

In the fixing apparatus according to aspect 5, in addition to the effect of the fixing apparatus according to aspect 4, the recording sheet is prevented from sticking to the heat-fixing roll.

In the fixing apparatus according to aspect 6, deformation is effectively caused to the resilient layer of the heat-fixing roll to ensure that the recording sheet is stripped off the heat-fixing roll.

What is claimed is:

1. A fixing apparatus, comprising:

a heat-fixing roll having heating means and being driven to rotate; and an endless pressure belt which is stretched under tension along a plurality of rolls and made to contact and be wound around said heat-fixing roll, said heat-fixing roll being provided with a first resilient layer on the peripheral surface thereof;

one of said plurality of rolls for stretching said pressure belt being a pressure roll which is located in a press contact portion where said pressure belt is forced to contact said heat-fixing roll on a downstream side in a direction of rotation of said heat-fixing roll, said pressure roll being pressed against said heat-fixing roll so that said first resilient layer undergoes compressional deformation;

an auxiliary pressure roll being provided on an upstream side of the press contact portion and forced to contact said heat-fixing roll via said pressure belt;

a soft, second resilient layer formed of material not harder than the material used to form said first resilient layer, and being formed on the peripheral surface of said auxiliary pressure roll; and wherein the press contact force of said auxiliary pressure roll with respect to said heat-fixing roll is set so that the sum of the press contact force thereof and the press contact force caused by the tension of said pressure belt made to contact and be wound around said heat-fixing roll is substantially equal to or greater than the pressing force of said pressure roll.

2. The fixing apparatus of claim 1, wherein distortion of the surface of said first resilient layer, in the circumferential direction, resulting from forcing said auxiliary pressure roll to contact said heat-fixing roll is not greater than 0.5%.

3. The fixing apparatus of claim 1, wherein distortion of the surface of said first resilient layer, in the circumferential direction, resulting from forcing said auxiliary pressure roll to contact said heat-fixing roll is in the range of 0.1% to 0.5%.

4. The fixing apparatus of claim 1, further comprising: a temperature sensor positioned adjacent to said pressure roll and used to control the temperature of said heat-fixing roll.

5. The fixing apparatus of claim 4, wherein the peripheral surface of said pressure roll is covered with a layer made of material harder than the material used for forming said resilient layer.

6. The fixing apparatus of claim 4, wherein the peripheral surface of said pressure roll is covered with a layer of material that is heat resistant to temperatures higher than the melting point of toner.

7. A fixing apparatus, comprising:

a heat-fixing roll having heating means and being driven to rotate; and an endless pressure belt which is stretched under tension along a plurality of rolls and made to contact and be wound around said heat-fixing roll;

wherein one of said plurality of rolls for stretching said pressure belt is a pressure roll which is pressed against said heat-fixing roll via said pressure belt, the peripheral surface of said pressure roll being covered with a layer of heat-resistant and heat-insulating material;

wherein another of said plurality of rolls is an auxiliary pressure roll; and wherein the press contact force of said auxiliary pressure roll with respect to said heat-fixing roll is set so that the sum of the press contact force thereof and the press contact force caused by the tension of said pressure belt made to contact and be wound around said heat-fixing roll is substantially equal to or greater than the pressing force of said pressure roll.

8. The fixing apparatus of claim 7, wherein said heat-fixing roll is provided with a resilient layer on the peripheral surface thereof; and said pressure roll is located on a downstream side of the contact portion of said pressure belt, in a direction of rotation of said heat-fixing roll, and pressed against said heat-fixing roll so that said resilient layer of said heat-fixing roll undergoes compressional deformation.

9. The fixing apparatus of claim 8, wherein the peripheral surface of said pressure roll is covered with a layer made of material harder than the material used for forming said resilient layer.

10. The fixing apparatus of claim 9, wherein the peripheral surface of said pressure roll is covered with a layer of material that is heat resistant to temperatures higher than the melting point of toner.

11. The fixing apparatus of claim 8, wherein the peripheral surface of said pressure roll is covered with a layer of material that is heat resistant to temperatures higher than the melting point of toner.

12. The fixing apparatus of claim 7, wherein the peripheral surface of said pressure roll is covered with a layer of material that is heat resistant to temperatures higher than the melting point of toner.

* * * * *